US005732949A

United States Patent [19]

Josephs

[11] Patent Number: 5,732,949

[45] Date of Patent: Mar. 31, 1998

[54] METHOD OF PLAYING A GAME OF TWO-HANDED BLACKJACK

[76] Inventor: Ronald H. Josephs, 4122 Clarinda Dr., Tarzana, Calif. 91356

[21] Appl. No.: 622,314

[22] Filed: Mar. 15, 1996

[51] Int. Cl.[6] ..... A63F 1/00

[52] U.S. Cl. ..... 273/292

[58] Field of Search ..... 273/292, 274, 273/309

[56] References Cited

U.S. PATENT DOCUMENTS

| | | | |
|---|---|---|---|
| 5,257,810 | 11/1993 | Schorr et al. | 273/292 |
| 5,280,915 | 1/1994 | Groussman | 273/292 |
| 5,322,295 | 6/1994 | Cabot et al. | 273/292 |

OTHER PUBLICATIONS

Maverick Blackjack, received in the PTO May 1995.
Top O'The Deck Blackjack, Sam's Town, Las Vegas, received in the PTO May 1995.

*Primary Examiner*—Benjamin H. Layno
*Attorney, Agent, or Firm*—Timothy T. Tyson; Ted Masters

[57] ABSTRACT

A modified version of the game of BLACKJACK includes a player playing first and second hands. The improvement of the present invention comprises the player receiving (a) a first supplemental payoff if the first and second hands both equal the hand of the dealers (b) a second supplemental payoff if the first and second hands are equal, or (c) a third supplemental payoff if either the first hand or the second hand equal the dealer's hand. In a preferred embodiment 20, the supplemental payoffs are offered at no additional cost to the player. In a second embodiment 120, the player places a side bet and the supplemental payoffs are adjusted accordingly.

35 Claims, 7 Drawing Sheets

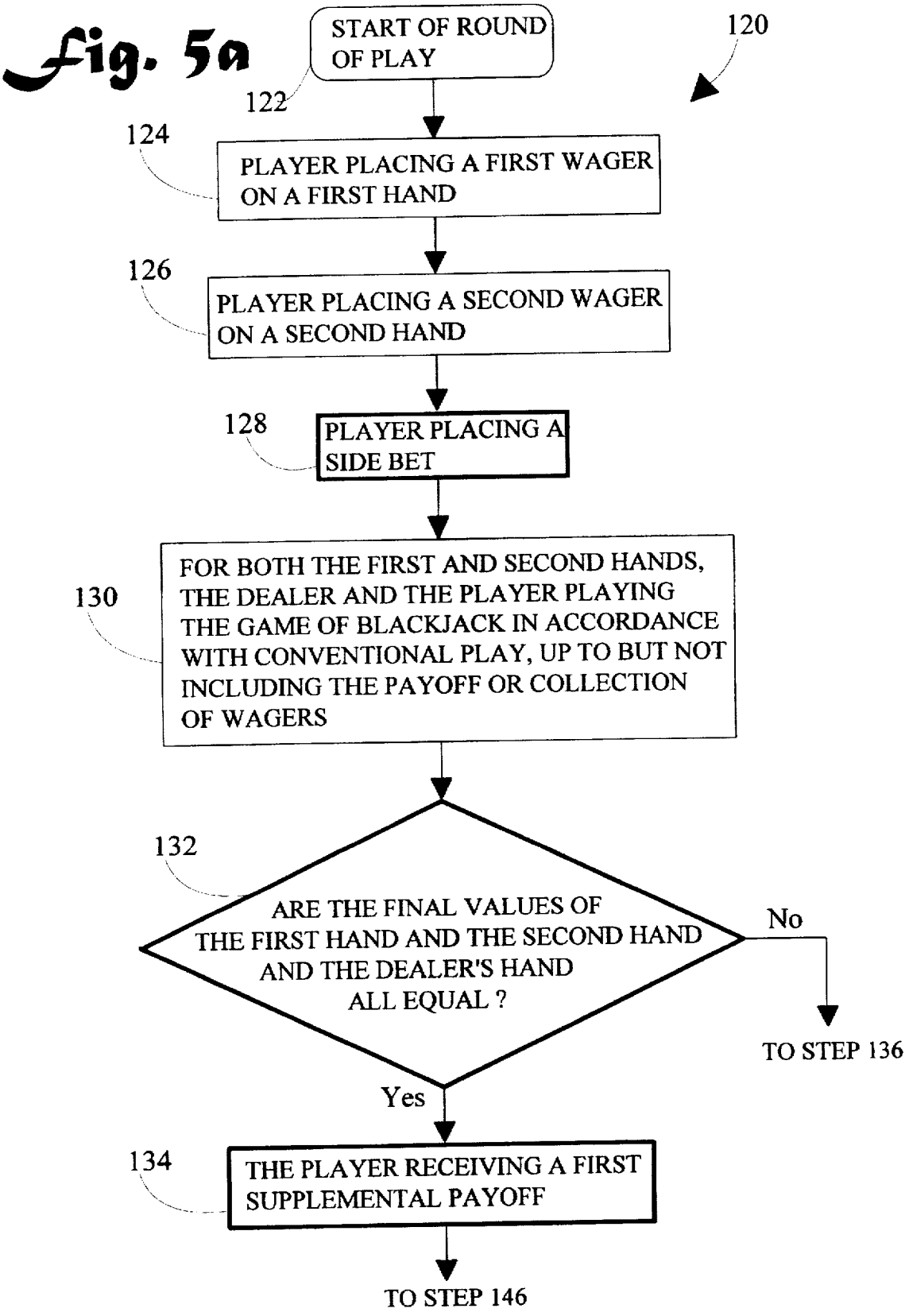
Fig. 5a
120
START OF ROUND OF PLAY
122
124
PLAYER PLACING A FIRST WAGER ON A FIRST HAND
126
PLAYER PLACING A SECOND WAGER ON A SECOND HAND
128
PLAYER PLACING A SIDE BET
130
FOR BOTH THE FIRST AND SECOND HANDS, THE DEALER AND THE PLAYER PLAYING THE GAME OF BLACKJACK IN ACCORDANCE WITH CONVENTIONAL PLAY, UP TO BUT NOT INCLUDING THE PAYOFF OR COLLECTION OF WAGERS
132
ARE THE FINAL VALUES OF THE FIRST HAND AND THE SECOND HAND AND THE DEALER'S HAND ALL EQUAL ?
No
TO STEP 136
Yes
134
THE PLAYER RECEIVING A FIRST SUPPLEMENTAL PAYOFF
TO STEP 146

METHOD OF PLAYING A GAME OF TWO-HANDED BLACKJACK

TECHNICAL FIELD

The present invention pertains to card games and more particularly to a two-handed version of the game of BLACKJACK, wherein a player plays two hands during a round of play.

BACKGROUND ART

Conventional rules of the card game BLACKJACK or Twenty-One are well known in the art and can be found in references such as:

1. Scarne's New Complete Guide to Gambling, John Scarne, Harper & Row, New York, 1973;
2. Scarne's Encyclopedia of Games, John Scarne, Harper & Row, New York 1973;
3. Hoyle's Modern Encyclopedia of Card Games, W. Gibson, Doubleday and Company, New York; and,
4. Official Rules of Card Games, Albert H. Morehead, Fawcet Crest, New York, 1990.

In a modified version of the game of BLACKJACK, a player can make two wagers and play two hands during a round of play. Such a two-handed version of the game of BLACKJACK is disclosed in U.S. Pat. No. 5,280,915 to Groussman, and is referred to as "Double Action Blackjack".

DISCLOSURE OF INVENTION

The present invention is directed to an improved version of the game of two-handed BLACKJACK, wherein the two-handed version includes a player playing both a first and second hand during a round of play. The player places a first wager on the first hand, and a second wager on the second hand. The game continues in accordance with conventional BLACKJACK play, with the player and the dealer standing or taking hits as the situation may dictate. At the completion of play, the first hand has a first final value, the second hand has a second final value, and the dealer's hand has a third final value. The final value is the numerical total of all cards in the hand (for example 17, 18, 19, 20, 21(with more than two cards), blackjack(21 with two cards), or Bust.

The two-handed playing format affords a player more interest and playing action without depriving another player of a place at the table, and additionally increases the revenue of the gaming establishment. The improvement of the present invention serves the player by offering the additional payoffs, and serves the gaming establishment by attracting more players, which ultimately results in higher profits.

In accordance with a preferred embodiment of the invention, the improvement comprises the player receiving a first supplemental payoff if the first final value and the second final value and the third final value are all equal, or if the three final values are not equal, the player receiving a second supplemental payoff if the first final value is equal to the second final value, or the player receiving a third supplemental payoff if either (a) the first final value is equal to the third final value or (b) the second final value is equal to the third final value.

In accordance with an important aspect of the invention, first, second, or third supplemental payoffs are made respectively if the final value of all three hands are blackjack, or if the final value of the player's two hands are blackjack, or if either (a) the first final value and third final value are blackjack or (b) the second final value and the third final value are blackjack.

In accordance with an important feature of the invention, the first and second supplemental payoffs are multiples of the first and second wagers, and the third supplemental payoff is a multiple of either (a) the first wager or (b) the second wager.

In accordance with another important feature of the invention, the supplemental payoffs are for fixed amounts.

In accordance with a preferred embodiment of the invention, the player places a side bet that either the first final value and the second final value and the third final value will all be equal, or that the first final value will equal the second final value, or that either (a) the first final value will equal the third final value or (b) the second final value will equal the third final value.

In accordance with an important aspect of the invention, the side bet is a progressive wager, a portion or which is added to a progressive pot, the first, seconds and third supplemental payoffs being derived from the progressive pot.

In accordance with an important feature of the invention, the first, second, and third supplemental payoffs may be in addition to a conventional BLACKJACK payoff, or alternatively may be in lieu of a conventional BLACKJACK payoff.

In accordance with another feature of the invention, the player receives a fourth supplemental payoff if either (a) the first hand, (b) the second hand, or (c) the third hand have a predetermined final value.

In accordance another important aspect of the invention, after placing a side bet, the player receives a fifth supplement payoff if one of the first hand or the second hand have a predetermined final value.

In accordance with another preferred embodiment of the invention, the improvement comprises the player receiving a first supplemental payoff if the first two cards dealt to the first hand and the first two cards dealt to the second hand and the first two cards dealt to the dealer are all of equal value, or if they are not of equal value, the player receiving a second supplemental payoff if the first two cards dealt to the first hand and the first two cards dealt to the second hand are of equal value, or the player receiving a third supplemental payoff if either (a) the first two cards dealt to the first hand equal the first two cards dealt to the dealer or (b) the first two cards dealt to the second hand equal the first two cards dealt to the dealer.

In accordance with a preferred embodiment of the invention, the player receives a supplemental payoff if either (a) the first final value is equal to the second final value, or (b) the first final value is equal to the third final value, or (c) the second final value is equal to the third final value.

Other features and advantages of the present invention will become apparent from the following detailed description, taken in conjunction with the accompanying drawings, which illustrate, by way of example, the principles of the invention.

MODES FOR CARRYING OUT THE INVENTION

The present invention is an improvement to the two-handed version of BLACKJACK (or Twenty-One) wherein a player plays two hand during a round of play, the improvement comprising the player receiving a first supplemental payoff if the final value of both of the player's two hands are the same and are equal to the final value of the dealer's hand. Alternatively, the player receives a second supplemental payoff if the final value of both of the player's hands are the same, but do not match the final hand of the dealer. Or, the player receives a third supplemental payoff if the final value of either of the player's hands match the final value of the dealer's hand. In a preferred embodiment the final value of the hands must be blackjack in order to receive the supplemental payoffs. It is noted that as used herein, BLACKJACK (in upper case letters) denotes the game, and blackjack (in lower case letters) denotes the value of a two card player or dealer hand which contains either an ace and a face card, or an ace and a 10.

Figure 1A:
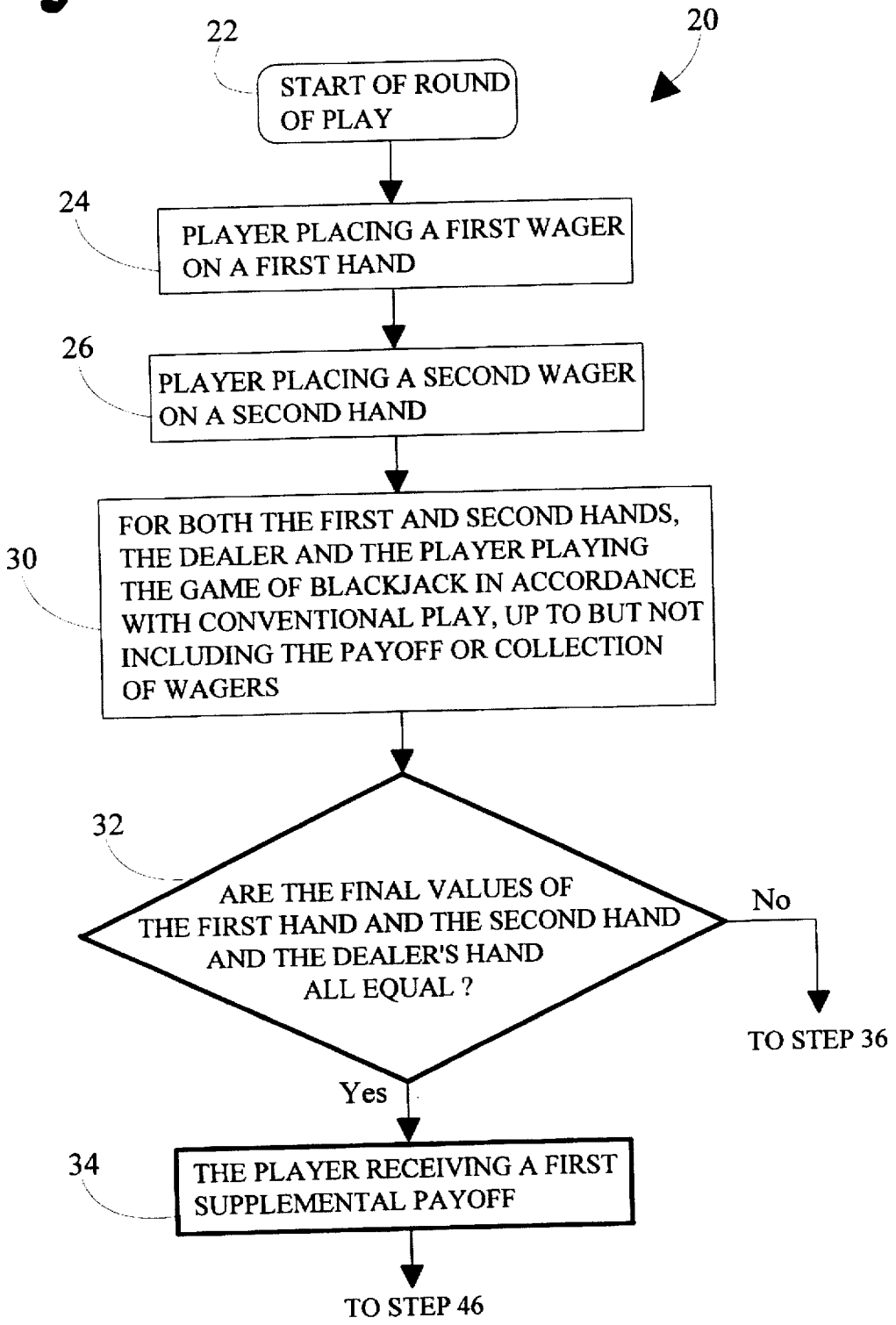
FIGS. 1*a*, 1*b* and 1*c* is a flow diagram illustrating the steps of a two-handed version of the game of BLACKJACK, to which has been added the improved method of play of the present invention.
Figure 1B:
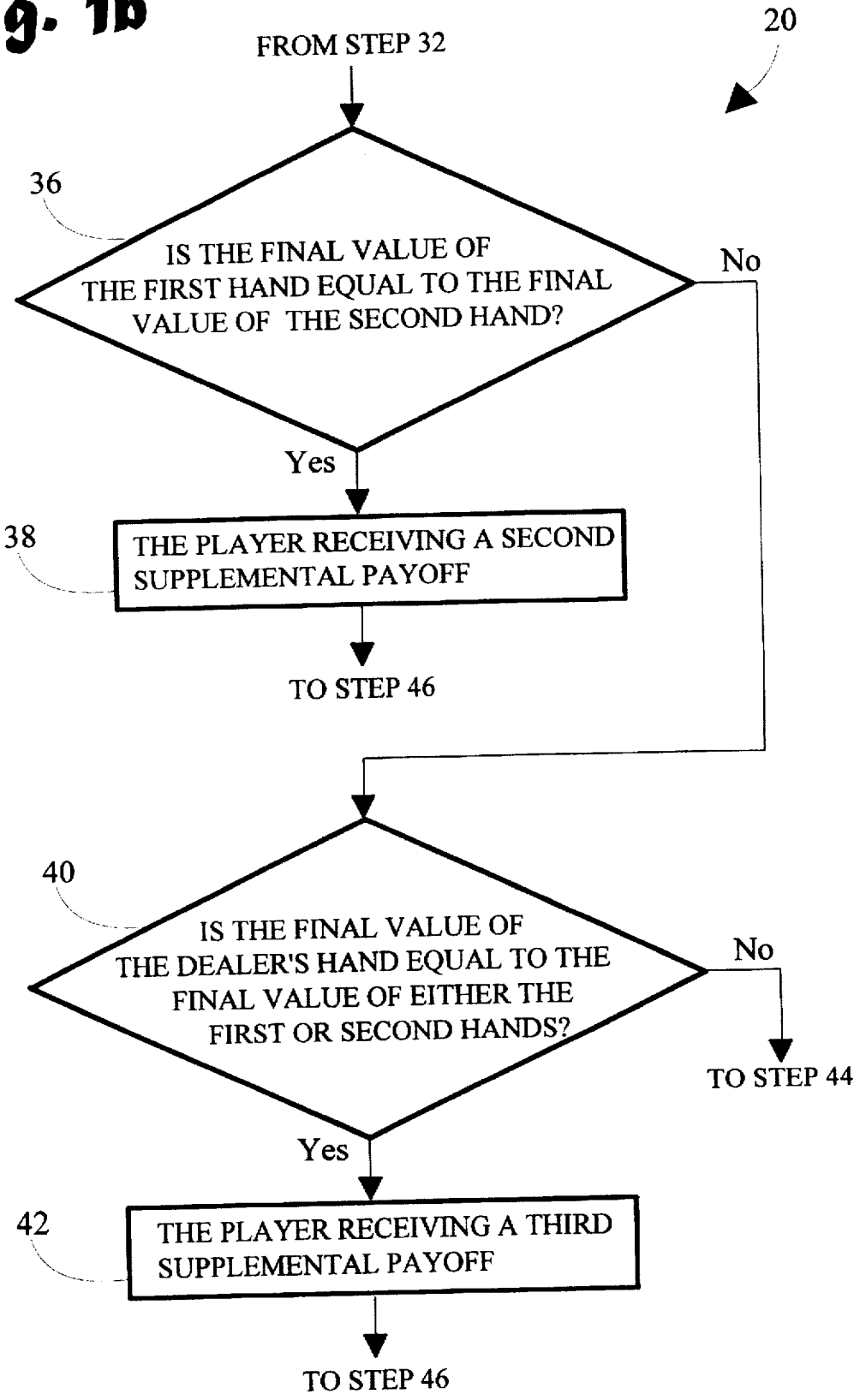
Figure 1C:
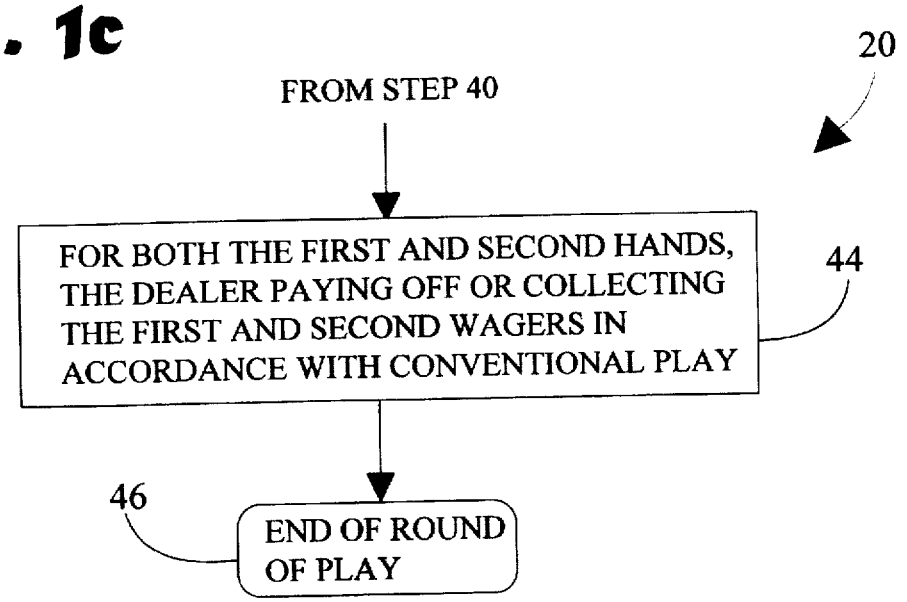

Referring initially to FIG. 1, there is depicted a flow diagram illustrating the steps of a two-handed version of the game of BLACKJACK including the improved method of play of the present invention, generally designated as 20. The two-handed version of the game of BLACKJACK allows a player to play two hands, a first hand and a second hands, during a round of play. Such a two-handed version of the game of BLACKJACK is disclosed in U.S. Pat. 5,280,915, however the present invention could be applied to any other two-handed version of BLACKJACK as well.

In the figure, steps 22, 24, 26, 30, 44 and 46 comprise the existing two-handed version of the game of BLACKJACK, and are shown with narrow borders. Steps 32, 34, 36, 38, 40, and 42 comprise the improved method of play in accordance with the present invention, and are shown with wide borders. For clarity of illustration, the flow diagram is directed to play between a dealer and a single player, but it can be appreciated that the steps of the improved game may be practiced by a plurality of players who are each playing in cooperation with the dealer. Additionally it is noted, that the present invention does not require any rule or procedural changes in the play of the two-handed version of the game of BLACKJACK other than that of the player receiving the supplemental payoffs.

A round of play of the game 20 begins with start terminator step 22 wherein the dealer calls for wagers. In step 24 the player places a first wager upon a first hand in accordance with conventional BLACKJACK play. In step 26 the player places a second wager upon a second hand. The first wager is placed in a first wager placement area 48, and the second wager is place in a second wager placement area 50 on the gaming table 52 (refer to FIG. 2). In step 30, for both the first and second hands, the dealer and the player play the game of BLACKJACK in accordance with conventional play, with the player playing a first hand and second hands and the dealer playing his/her hand. This playing methodology typically includes: the dealer dealing the player a first two-card hand, and a second two-card hand; the dealer dealing him/herself a two card hand; the player taking hits or standing on the first hand and the second hand, and/or making additional bets such as insurance, doubling down, splitting pairs; and, the dealer taking hits or standing on his/her hand. At the completion of this step, and after any hits are taken, the first hand will have a first final value, the second hand will have a second final value, and the dealer's hand will have a third final value. In a preferred embodiment the player will take hits, stands or make additional bets on the first hand, and then on the second hand. It is noted that step 30 does not include the payoff or collection of wagers in accordance with conventional BLACKJACK play. This is accomplished in step 44 below, and only if no supplemental payoffs in accordance with the present invention have been made. Also if a player elects to split a pairs the first card of the pair to receive an additional card will be considered the hand being played.

In step 32, after the first second, and third hands are hit or stand and have first, second and third final values respectively, it is observed whether the final values of the first hand and the second hand and the dealer's hand are all equal. If the three final values are all equal (Yes), in step 34 the player receives a first supplemental payoff. Play then proceeds to end terminator step 46 and the round of play is ended. If the three final values are not all equal (No), then play proceeds to step 36. In step 36 it is observed whether the first final value is equal to the second final value. If the two final values are equal (Yes), in step 38 the player receives a second supplemental payoff, and play proceeds to end terminator step 46 and the round of play is ended. If in step 36 the two values are not equal (No), play proceeds to step 40. In step 40 it is observed if either (a) the first final value is equal to the third final value, or (b) the second final value is equal to the third final value. If either (a) or (b) are true (Yes), in step 42 the player receives a third supplemental payoff and play proceeds to end terminator step 46 and the round of play is ended. If in step 40 neither (a) or (b) is true (No), play proceeds to step 44 wherein the first and second wagers are paid or collected in accordance with conventional play. Then in step 46, the round of play is ended as before. It is noted that the first, second, and third supplemental payoffs are mutually exclusive. That is, if the player receives a first supplemental payoff, he/she does not receive a second or third supplemental payoff. Similarly, if the player receives a second supplemental payoff, he/she does not receive a third supplemental payoff.

In a preferred embodiment, (1) the first supplemental payoff is made if the first, second, and third final values are all blackjack, (2) the second supplemental payoff is made if the first and second final values are both blackjack and the third final value is not blackjack (the third final value must be different from the first and second final values), and (3) the third supplemental payoff is made if either the first and third final values are both blackjack, or the second and third final values are both blackjack. It is noted however, that other final values such as 21 with three or more cards, 20, 19, 18, 17, and Bust could also be utilized. For example, a first supplemental payoff could be made if all three hands had a final value of 21 with three or more cards, or a second supplemental payoff could be made if both the player's hands had a final value of 21 with three or more cards or a third supplemental payoff could be made if the dealer's hand had a final value of 21 with three or more cards and one of the player's hands also had a final value of 21 with three or more cards. Similarly, final values such as 17, 18, 19 20, and Bust could be used. Or, in another embodiment, the first, second, and third supplemental payoffs could comprise a plurality of different payoffs dependent upon the specific first, second, and third final values. That is, the player would receive the supplemental payoffs if the necessary triplicate or duplicate of any of the possible final values occurred. In this case, the amounts of the supplemental payoffs would be different for each of the different final values.

The amounts of the first, second, and third supplemental payoffs are determined by the gaming establishment, and are designed to attract players, offer the players an incentive to play two hands, while on the other hand not being so large as to significantly erode gaming establishment profits. If the final values must be blackjack, the odds playing six decks are approximately:

first supplemental payoff—9,261 to 1 second supplemental payoff—463 to 1 third supplemental payoff—232 to 1

Therefore, the amount of the first supplemental payoff for triple blackjacks could range anywhere between about 11,000 through 1.5 to 1. Or in other words, the amount of the first supplemental payoff could be anywhere between about 11,000 through 1.5 times the sum of the first and second wagers. 1.5 is the lower limit since that is the normal payoff for a blackjack. It is the sum of the first and second wagers that is stated since both wagers are paid at the same rate.

The amount of the first supplemental payoff can be adjusted upwardly (toward 11,000 to 1) by the gaming establishment to attract players. Conversely, the amount of the first supplemental payoff can be adjusted downwardly (toward 1.5 to 1) to maximize the profits of the gaming establishment. A first supplemental payoff amount about 10 times the sum of the first and second wagers is a preferred embodiment.

Similarly, the amount of the second supplemental payoff for double blackjacks in the player's two hands could range anywhere between about 500 through 1.5 to 1. Or in other words, the amount of the second supplemental payoff could be anywhere between about 500 through 1.5 times the sum of the first and second wagers. Also, the amount of the second supplemental payoff can be adjusted upwardly (toward 500 to 1) by the gaming establishment to attract players. Conversely, the amount of the second supplemental payoff can be adjusted downwardly (toward 1.5 to 1) to maximize the profits of the gaming establishment. A second supplemental payoff amount about 3 times the sum of the first and second wagers is a preferred embodiment.

Similarly, the amount of the third supplemental payoff for a blackjack in the dealer's hand and also a blackjack in either of the player's two hands could range anywhere between about 300 through 1.5 to 1. Or in other words, the amount of the third supplemental payoff could be anywhere between about 300 through 1.5 times either the first or second wager. It is the first or second wager rather than the sum of the first and second wagers since only one of the player's hands contains the required final value. Also, the amount of the third supplemental payoff can be adjusted upwardly (toward 300 to 1) by the gaming establishment to attract players. Conversely, the amount of the third supplemental payoff can be adjusted downwardly (toward 1.5 to 1) to maximize the profits of the gaming establishment. A third supplemental payoff amount about 2 times either the first or second wager is a preferred embodiment.

It is noted that for the embodiment of FIG. 1, the player makes no additional wager or side bet, yet can still receive the supplemental payoffs. Therefore, since all of the supplemental payoffs are being deducted from the gaming establishment's normal profits, the payoffs will usually, but not always, be set nearer to the lower limit of 1.5 to 1, rather than to the upper limits of 11,000 to 1500 to 1, or 300 to 1.

In a sample round of play, wherein the final value of the hands must be blackjack, assume that the player's first wager on the first hand is $100 and the players second wager on the second hand is $200. After the cards are dealt, the final value of the player's first hand is a blackjack, the final value of the player's second hand is a blackjack, and the final value of the dealer's hand is also a blackjack. If the a first supplemental payoff is 10 to 1, the player would receive $3,000 [($100+$200)×10], and the round of play would end. It is noted, that for a blackjack hand, the final and initial values of the hands are the same since no hits are taken.

Under the same conditions except that the dealer does not have blackjack, at a second supplemental payoff of 3 to 1, the player would receive a second supplemental payoff of $900 [($100+$200)×3], and the round of play would end.

Lastly, if the dealer has a blackjack, and the player's first hand is a blackjack, at a payoff of 2 to 1, the player would receive a third supplemental payoff of $200 [$100×2]. Or, if the dealer has a blackjack, and the player's second hand is a blackjack, at a payoff of 2 to 1 the player would receive a third supplemental payoff of $400 [$200×2].

As described above the first and second supplemental payoffs are multiples of the sum of the first and second wagers, and the third supplemental payoff is a multiple of either the first or second wager. It is noted however, that alternatively the first, second, and third supplemental payoffs could be for fixed (bonus) amounts, and would be paid in addition to the conventional payoffs. For example, the first supplemental payoff could be $1,000 and the second supplemental payoff could be $200, and the third supplemental payoff could be $100 irrespective of the amounts of the first and second wagers. Or in another preferred embodiment, the second and third supplemental payoffs could be combined. That is, the player would receive the same supplemental payoff amount, for example $150, if either (a) the first final value is equal to the second final value, or (b) the first final value is equal to the third final value, or (c) the second final value is equal to the third final value. The odds in this case are approximately 154 to 1.

In another embodiment, the firsts second, and third supplemental payoffs constitute bonus payoffs that are made in addition to any conventional BLACKJACK payoff. In other words, the player may receive a bonus supplemental payoff in addition to receiving a 1.5 to 1 payoff for having one or two blackjack hands. This embodiment modifies the steps of FIG. 1 slightly by having steps 34, 38 and 40 feed step 44 rather than step 46.

Also, while the preferred embodiment is for the player to receive either the first supplemental payoff, or the second supplemental payoff, or the third supplemental payoff as appropriate, the improved game 20 could also be played with the player receiving just the first supplemental payoff with no second or third supplemental payoffs offered, or alternatively the player receiving just the second supplemental payoff with no first or third supplemental payoff offered, or alternatively the player receiving just the third supplemental payoff with no first or second supplemental payoff offered.

In another possible embodiment, it is not the final value of the first, second, and dealer's hands that is used to determine the supplemental payoffs, but rather the value of the first two cards dealt to each of the hands. The two-handed version of the game of BLACKJACK includes the player playing both a first hand and a second hand during a round of play and placing a first wager and a second wager respectively thereon; the dealer playing a hand; after the first two cards are dealt to the first hand and to the second hand and to the dealer's hand, the first hand has a first value the second hand has a second value and the dealer's hand has a third value. The player receives a first supplemental payoff if the first value and the second value and the third value are all equal. The player receives a second supplemental payoff if the first value is equal to the second value, and is different from the third value. The player receives a third supplemental payoff if either (a) the first value is equal to the third value, or (b) the second value is equal to the third value. For example, if all three two-card hands had a value of fifteen, a first supplemental payoff could be made.

Figure 2:
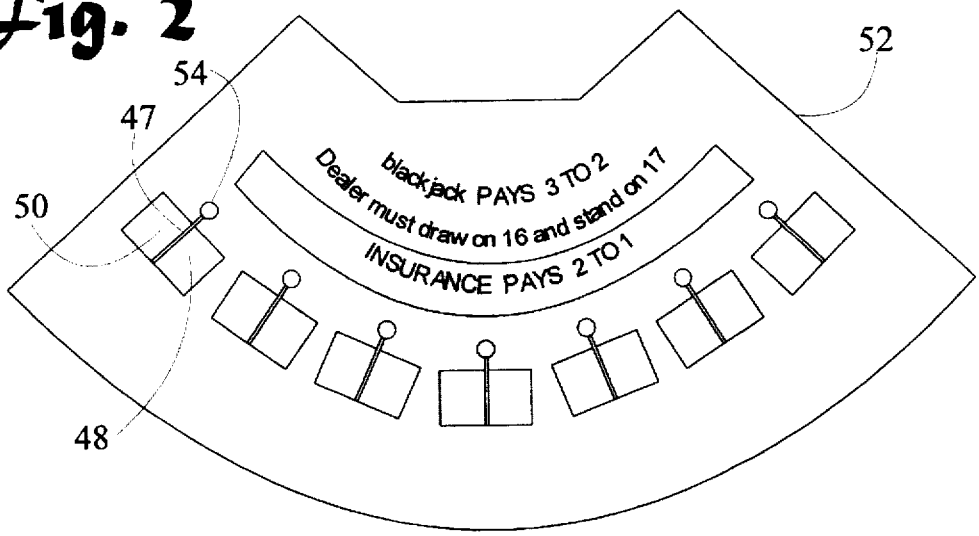
FIG. 2 is a top plan view of a modified BLACKJACK gaming showing a plurality of first and second wager placement areas.

FIG. 2 is a top plan view of a modified BLACKJACK gaming table 52, having indicia showing a plurality of first 48 and second 50 wager placement areas. The first 48 and second 50 wage placement areas for each player are adjacent, and separated by dividing line 47. The figure shows first 48 and second 50 wage placement areas for seven players, however a greater or lesser number of players could also be used. The figure also shows a diagram having typical indicia associated with conventional BLACKJACK play, comprising "BLACKJACK PAYS 3 TO 2", "Dealer must draw on 16 and stand on 17", and "INSURANCE PAYS 2 TO 1". These indicia could change according to the specific rules of play utilized by the gaming establishment. For example, in one BLACKJACK playing option, the dealer is permitted to draw on a "soft 17 hand" (one that contains an ace), and the indicia would be revised accordingly. FIG. 2 also shows a side bet (side wager) placement area 54 located above first 48 and second 50 wage placement areas. Alternatively, side bet placement area could be located elsewhere on the BLACKJACK gaming table 52, such as above the INSURANCE PAYS 2 TO 1 indicia.

Figure 3:
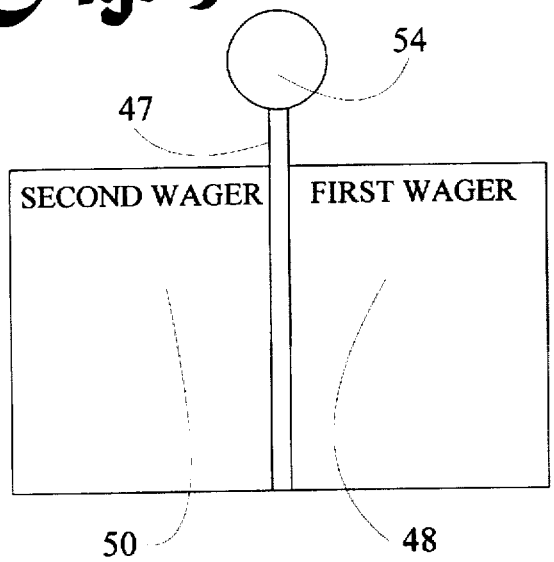
FIG. 3 is an enlarged top plan view of the first and second wage placement areas of FIG. 2.

FIG. 3 is an enlarged top plan view of the first 48 and second 50 wage placement areas and dividing line 47 of FIG. 2. Indicia denoting the first and second wager is provided. Side bet placement area 54 is also provided, wherein a player may make a side bet.

Figure 4:
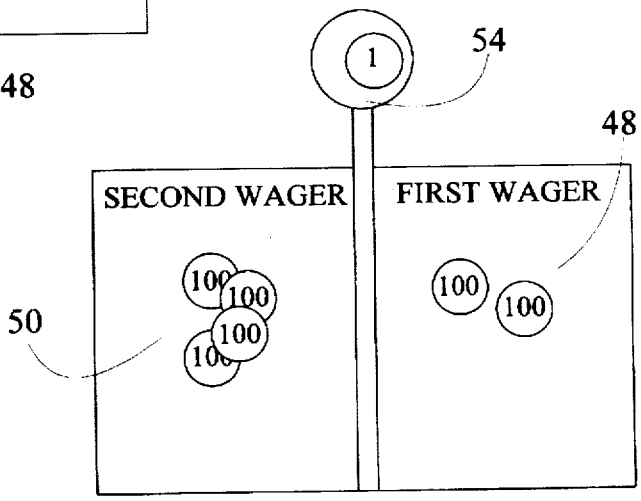
FIG. 4 is an enlarged top plan view of the first and second wage placement areas showing wagers placed thereon; and, FIGS. 5*a*, 5*b* and 5*c* is a flow diagram illustrating the steps of a second embodiment.

FIG. 4 is an enlarged top plan view of the first 48 and second 50 wage placement areas showing wagers placed thereon. In the shown embodiment the first wager on the first hand is two hundred units, and the second wager on the second hand is four hundred units, and the side bet is one unit. In another embodiment not shown in FIGS. 2 through 4, indicia depicting the amount of the supplemental payoffs is disposed on the gaming table or a covering thereof (e.g. 10 to 1 and 3 to 1).

Figure 5B:
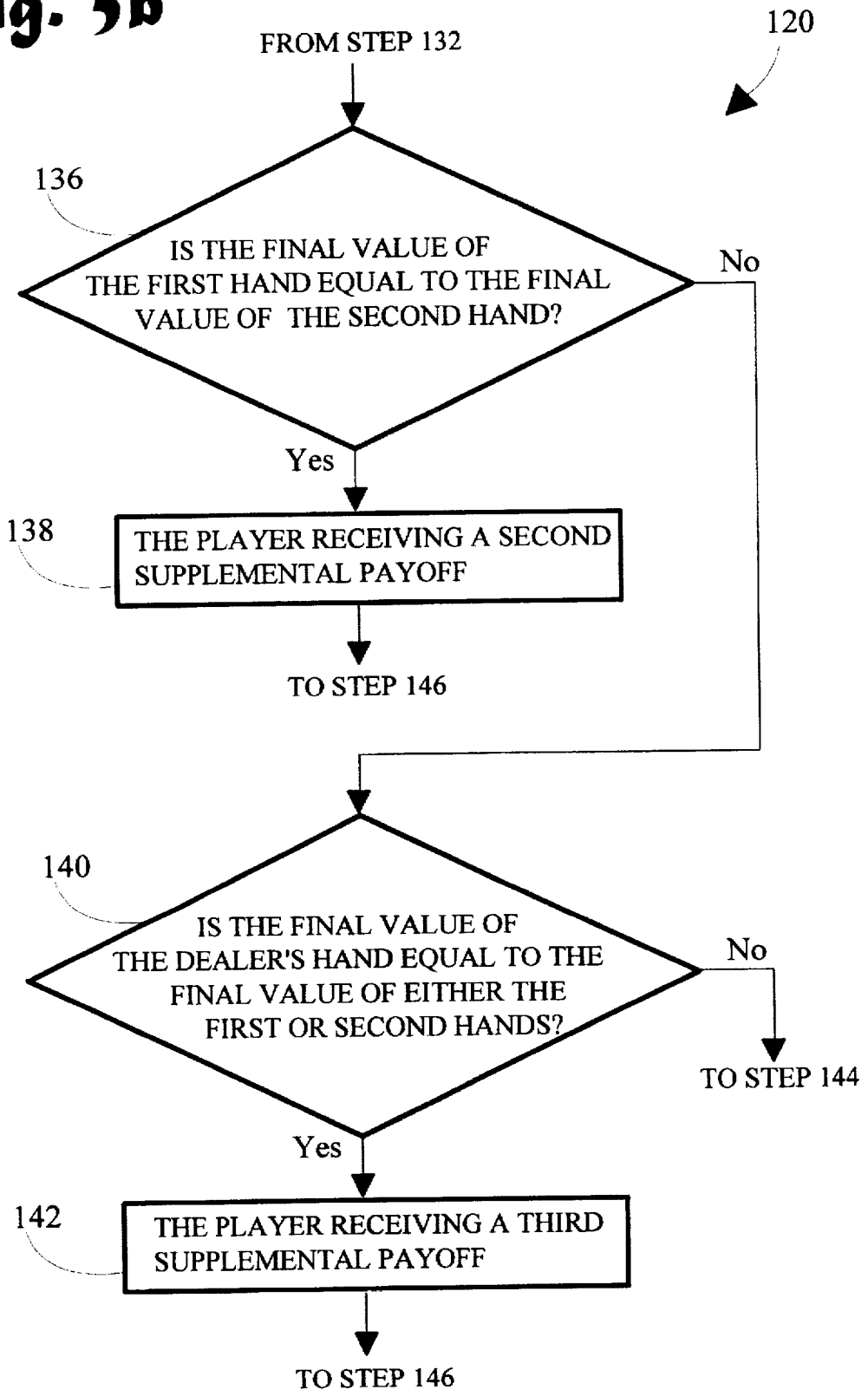
Figure 5C:
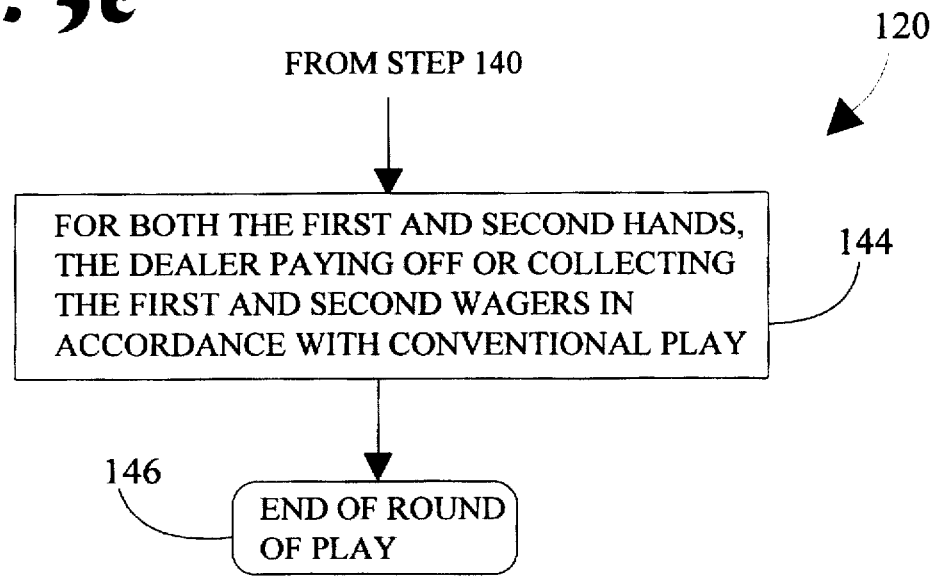

FIG. 5 is a flow diagram illustrating the steps of a second embodiment, generally designated as 120. This embodiment is similar to the improved method of play 20 of FIG. 1, however a side bet (side wager) option is added. In the side bet embodiment 120 the player receives supplemental payoffs that are a multiple of the side bet, rather than being a multiple of the sum of the first and second wagers (first and second supplemental payoffs), or a multiple of either the first or second wager (third supplemental payoff) as in embodiment 20. The side bet embodiment 120 can be used separately, or may be used in conjunction with embodiment 20. That is, one player at the table could make a side bet, while another player at the table elects not to do so.

In the figure, steps 122, 124, 126, 130, 144 and 146 comprise the existing two-handed version of the game of BLACKJACK, and are shown with narrow borders. Steps 128, 132, 134, 136, 138, 140, and 142 comprise the improved method of play in accordance with the present invention, and are shown with wide borders. For clarity of illustration, the flow diagram is directed to play between a dealer and a single player, but it can be appreciated that the steps of the improved game may be practiced by a plurality of players who are each playing in cooperation with the dealer.

A round of play of the game 120 begins with start terminator step 122 wherein the dealer calls for wagers. In step 124 the player places a first wager upon a first hand in accordance with conventional BLACKJACK play. In step 126 the player places a second wager upon a second hand. The first wager is placed in a first wager placement area 48, and the second wager is place in a second wager placement area 50 on the gaming table 52 (refer to FIG. 2).

In step 128 the player places a side bet. The side bet is placed in side bet placement area 54 (refer to FIG. 2). The side bet embodiment does not require any rule or procedural changes in the play of the two-handed version of the game of BLACKJACK other than that of the player placing the side bet and as appropriate receiving a supplemental payoff. Therefore, players who do not wish to avail themselves of the present invention's side bet option can play in the conventional manner, even while other players at the same gaming table are placing side bets.

In step 130, for both the first and second hands, the dealer and the player play the game of BLACKJACK in accordance with conventional play, with the player playing a first hand and second hand, and the dealer playing his/her hand. This playing methodology typically includes: the dealer dealing the player a first two-card hand, and a second two-card hand; the dealer dealing him/herself a two card hand; the player taking hits or standing on the first hand and the second hand, and/or making additional bets such as insurance, doubling down, splitting pairs; and, the dealer taking hits or standing on his/her hand. At the completion of this step, and after any hits are taken, the first hand will have a first final value, the second hand will have a second final value, and the dealer's hand will have a third final value. In a preferred embodiment the player will take hits, stand; or make additional bets on the first hand, and then on the second hand. It is noted that step 130 does not include the payoff or collection of wagers in accordance with conventional BLACKJACK play. This is accomplished in step 144 below, only if no payoffs in accordance with the present invention have been made. Also, if a player elects to split a pair, the first card of the pair to receive an additional card will be considered the hand being played.

In step 132, after the first, second, and third hands are hit or stand and have first second, and third final values respectively, it is observed whether the final values of the first hand and the second hand and the dealer's hand are all equal. If the three final values are all equal (Yes), in step 134 the player receives a first supplemental payoff. Play then proceeds to end terminator step 146 and the round of play is ended. If the three final values are not all equal (No), then play proceeds to step 136. In step 136 it is observed whether the final value of the first hand is equal to the final value of the second hand. If the two final values are equal (Yes), in step 138 the player receives a second supplemental payoff, and play proceeds to end terminator step 146 and the round of play is ended. If in step 136 the two values are not equal (No), play proceeds to step 140. In step 140 it is observed if either (a) the first final value is equal to the third final value, or (b) the second final value is equal to the third final value. If either (a) or (b) are true (Yes), in step 142 the player receives a third supplemental payoff, and play proceeds to end terminator step 146 and the round of play is ended. If in step 140 neither (a) or (b) is true (No), play proceeds to step 144 wherein the first and second wagers are paid or collected in accordance with conventional play. Then in step 146, the round of play is ended as before. It is noted that the first, second and third supplemental payoffs are mutually exclusive. That is, if the player receives a first supplemental payoff, he/she does not receive a second or third supplemental payoff. Similarly, if the player receives a second supplemental payoff, he/she does not receive a third supplemental payoff.

In a preferred embodiment, (1) the first supplemental payoff is made if the first, second, and third final values are all blackjack, (2) the second supplemental payoff is made if the first and second final values are both blackjack and the third final value is not blackjack (the third final value must be different from the first and second final values), and (3) the third supplemental payoff is made if either the first and third final values are both blackjack, or the second and third final values are both blackjack.

It is noted however, that other final values such as 21 with three or more cards, 20, 19, 18, 17, and Bust could also be utilized. For example, a first supplemental payoff could be made if all three hands had a final value of 21 with three or more cards, or a second supplemental payoff could be made if both the player's hands had a final value of 21with three or more cards, or a third supplemental payoff could be made if the dealer's hand had a final value of 21 with three or more cards and one of the player's hands also had a final value of 21 with three or more cards. Similarly, final values such as 17, 18, 19, 20, and Bust could be used. Or, in another embodiment, the first, second, and third supplemental payoffs could comprise a plurality of different payoffs dependent upon the specific first, second, and third final values. That is, the player would receive the supplemental payoffs if the necessary triplicate or duplicate of any of the possible final values occurred. In this case, the amounts of the supplemental payoffs would be different for each of the different final values.

The amounts of the first and second supplemental payoffs are determined by the gaming establishments, and are designed to attract players, offer the players an incentive to play two hands, while on the other hand not being so large as to significantly erode gaming establishment profits. If the final values must be blackjacks, the odds playing six decks are approximately:

first supplemental payoff—9,261 to 1 second supplemental payoff—463 to 1 third supplemental payoff—232 to 1

Therefore, the amount of the first supplemental payoff for triple blackjacks could range anywhere between about 11,000 through 1.5 to 1. Or in other words, the amount of the first supplemental payoff could be anywhere between about 11,000 through 1.5 times the side bet. The amount of the first supplemental payoff can be adjusted upwardly (toward 11,000 to 1) by the gaming establishment to attract players. Conversely, the amount of the first supplemental payoff can be adjusted downwardly (toward 1.5 to 1) to maximize the profits of the gaming establishment. A first supplemental payoff amount about 100 times the sum of the side bet is a preferred embodiment.

Similarly, the amount of the second supplemental payoff for double blackjacks in the player's two hands could range anywhere between about 500 through 1.5 to 1. Or in other words, the amount of the second supplemental payoff could be anywhere between about 500 through 1.5 times the side bet. Also, the amount of the second supplemental payoff can be adjusted upwardly (toward 500 to 1) by the gaming establishment to attract players. Conversely, the amount of the second supplemental payoff can be adjusted downwardly (toward 1.5 to 1) to maximize the profits of the gaming establishment. A second supplemental payoff amount about 25 times the side bet is a preferred embodiment.

Similarly, the amount of the third supplemental payoff for a blackjack in the dealer's hand and also a blackjack in either of the player's two hands could range anywhere between about 300 through 1.5 to 1. Or in other words, the amount of the third supplemental payoff could be anywhere between about 300 through 1.5 times the side bet. Also, the amount of the third supplemental payoff can be adjusted upwardly (toward 300 to 1) by the gaming establishment to attract players. Conversely the amount of the third supplemental payoff can be adjusted downwardly (toward 1.5 to 1) to maximize the profits of the gaming establishment. A third supplemental payoff amount about 25 times the side bet is a preferred embodiment.

It is noted that for the embodiment of FIG. 5, the player makes an additional side bet which is taken by the gaming establishment. Therefore, he or she is normally entitled to larger supplemental payoffs than in non-side bet embodiment 20 of FIG 1.

In a sample round of play, wherein the final value of the hands must be blackjack, assume that the player's first wager on the first hand is $50 and the players second wager on the second hand is $100 , and that the player has placed a $1 side bet. After the cards are dealt, the final value of the player's first hand is a blackjack, the final value of the player's second hand is a blackjack, and the final value of the dealer's hand is also a blackjack. If the a first supplemental payoff is 100 to 1, the player would receive $100 ($1×100), and the round of play would end. It is noted, that for a blackjack hand, the final and initial values of the hand are the same since no hits are taken.

Under the same conditions except that the dealer does not have blackjack, at a second supplemental payoff of 25 to 1, the player would receive a second supplemental payoff of $25 ($1×25), and the round of play would end.

Similarly, if the dealer has blackjack and either of the player's two hands have blackjack, at a third supplemental payoff of 25 to 1, the player would receive a third supplemental payoff of $25 ($1×25).

As described above the first, second, and third supplemental payoffs are multiples of the side bet. It is noted however, that alternatively the first and second supplemental payoffs could be for fixed amounts. For example, the first supplemental payoff could be $5,000, the second supplemental payoff could be $500, and the third supplemental payoff could be $200 irrespective of the amount of the side bet. Or in another preferred embodiment, the second and third supplemental payoffs could be combined. That is, the player would receive the same supplemental payoff amount for example $300 if either (a) the first final value is equal to the second final value, or (b) the first final value is equal to the third final value, or (c) the second final value is equal to the third final value. The odds in this case are approximately 154 to 1.

In another embodiment, the first and second supplemental payoffs constitute bonus payoffs that are made in addition to any conventional BLACKJACK payoffs. In other words, the player may receive a bonus supplemental payoff in addition to receiving two 1.5 to 1 payoffs for having two blackjack hands. This embodiment modifies the steps of FIG. 5 slightly by having steps 134, 138, and 142 feed step 144 rather than step 146.

The side bet can also be a progressive wager, a portion of which is added to a progressive pot from which the first, second, and third supplemental payoffs are derived. That is, a portion of the side bets of a plurality of players are accumulated to form an ever-increasing pot. When a player achieves a triple or double blackjack, the player receives an appropriate amount from the pot. The accumulation may be from all players at the table, or may be from all players at a plurality of tables.

In another possible embodiment, it is not the final value of the first, second, and dealer's hands that is used to determine the supplemental payoffs, but rather the value of the first two cards dealt to each of the hands. The two-handed version of the game of BLACKJACK includes the player playing both a first hand and a second hand during a round of play and placing a first wager and a second wager respectively thereon; the dealer playing a hand; after the first two cards are dealt to the first hand and to the second hand and to the dealer's hand, the first hand has a first value, the second hand has a second value and the dealer's hand has a third value. The player receives a first supplemental payoff if the first value and the second value and the third value are all equal. The player receives a second supplemental payoff if the first value is equal to the second value, and is different from the third value. The player receives a third supplemental payoff if either (a) the first value is equal to the third value, or (b) the second value is equal to the third value. For example, if all three two-card hands had a value of fifteen, a first supplemental payoff would be made.

Another possible embodiment of improved game 120 includes the player receiving a fourth supplemental payoff if only one of the first hand and the second hand and the dealer's hand have a predetermined final value, blackjack being preferred. The odds in this case are about 7.72 to 1, therefore a fourth supplemental payoff of about 10 through 1.5 times the side bet would be appropriate. A fourth supplemental payment of about 5 times the side bet is a preferred embodiment.

Another possible embodiment of improved game 120 includes the player receiving a fifth supplemental payoff if either the player's first hand or second hand have a predetermined final value, blackjack being preferred. The odds in this case are about 11.6 to 1, therefore a fifth supplemental payoff of about 15 through 1.5 times the side bet would be appropriate. A fifth supplemental payment of about 5 times the side bet is a preferred embodiment.

As in embodiment 20, the side bet game of embodiment 120 could also be played only considering the first two cards of the player's two hands and the dealer's hand.

The games depicted in FIGS. 1 through 5, and the associated wager and side bet placement areas, are suitable for use with a casino gaming table. It may be appreciated however, that modifications and rearrangements of the indicia representing the wager and side bet placement areas and supplemental payoffs could be tailored for use with a screen-type video display such as that of a personal computer monitor or specially designed video slot machine. In this embodiment a control panel such as a keyboard would allow a player to play against a dealer by making wagers and side bets, receiving cards, and being awarded supplemental payoffs in accordance with the teachings of the present invention.

It may be appreciated that in the play of the game of two-handed BLACKJACK, the various supplemental payoffs described herein may be used singularly, or may be used in combinations of two or more payoffs.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. An improved method for a player and a dealer to play a two-handed version of the game of BLACKJACK, wherein the two-handed version of the game of BLACKJACK includes the player playing both a first hand and a second hand during a round of play and placing a first wager and a second wager respectively thereon; the dealer playing a hand; after any hits are taken the first hand having a first final value, the second hand having a second final value, and the dealer's hand having a third final value; the improvement comprising the steps of:

the player receiving a first supplemental payoff if the first final value and the second final value and the third final value are all equal;

if the first final value and the second final value and the third final value are not all equal, the player receiving a second supplemental payoff if the first final value is equal to the second final value; and, if the first final value and the second final value and the third final value are not all equal, the player receiving a third supplemental payoff if one of (a) the first final value is equal to the third final value and (b) the second final value is equal to the third final value.

2. The method according to claim 1, wherein said first, second, and third supplemental payoffs comprise a plurality of different payoffs dependent upon the specific first, second, and third final values.

3. The method according to claim 1, wherein said first and second supplemental payoffs are multiples of the sum of the first and second wagers.

4. The method according to claim 1, wherein said third supplemental payoff is a multiple of one of (a) the first wager and (b) the second wager.

5. The method according to claim 1, wherein said first, second, and third supplemental payoffs are fixed amounts.

6. The method according to claim 1, is wherein said first supplemental payoff is made if the first final value and the second final value and the third final value are all blackjack, and wherein said second supplemental payoff is made if the first final value and the second final value are both blackjack, and wherein said third supplemental payoff is made if one of (a) the first final value and the third final value are both blackjack and (b) the second final value and the third final value are both blackjack.

7. The method according to claim 6, said first supplemental payoff being in the amount of between about 11,000 through 1.5 times the sum of the first and second wagers.

8. The method according to claim 7, wherein said first supplemental payoff is about 10 times the sum of the first and second wagers.

9. The method according to claim 6 said second supplemental payoff being in the amount of about between 500 through 1.5 times the sum of the first and second wagers.

10. The method according to claim 9, wherein said second supplemental payoff is about 3 times the sum of the first and second wagers.

11. The method according to claim 6 said third supplemental payoff being in the amount of about between 300 through 1.5 times one of (a) the first wager and (b) the second wager.

12. The method according to claim 11, wherein said third supplemental payoff is about 2 times one of (a) the first wager and (b) the second wager.

13. An improved method for a player and a dealer to play a two-handed version of the game of BLACKJACK wherein the two-handed version of the game of BLACKJACK includes the player playing both a first hand and a second hand during a round of play and placing a first wager and a second wager respectively thereon; the dealer playing a hand; after any hits are taken the first hand having a first final value, the second hand having a second final value, and the dealer's hand having a third final value; the improvement comprising the steps of:

the player placing a side bet;

the player receiving a first supplemental payoff if the first final value and the second final value and the third final value are all equal;

if the first final value and the second final value and the third final value are not all equal, the player receiving a second supplemental payoff if the first final value is equal to the second final value; and, if the first final value and the second final value and the third final value are not all equal, the player receiving a third supplemental payoff if one of (a) the first final value is equal to the third final value and (b) the second final value is equal to the third final value.

14. The method according to claim 13, wherein said first, second, and third supplemental payoffs comprise a plurality of different payoffs dependent upon the specific first, second, and third final values.

15. The method according to claim 13, wherein said first, second, and third supplemental payoffs are multiples of said side bet.

16. The method according to claim 13, wherein said first, second, and third supplemental payoffs are fixed amounts.

17. The method according to claim 16, wherein said first, second, and third supplemental payoffs are in addition to any conventional BLACKJACK payoffs.

18. The method according to claim 13, wherein said side bet is a progressive wager, a portion of which is added to a progressive pot, said first, second and third supplemental payoffs being derived from said progressive pot.

19. The method according to claim 13, wherein said first supplemental payoff is made if the first final value and the second final value and the third final value are all blackjack, and wherein said second supplemental payoff is made if the first final value and the second final value are both blackjack and wherein said third supplemental payoff is made if one of (a) the first final value and the third final value are both blackjack and (b) the second final value and the third final value are both blackjack.

20. The method according to claim 19, said first supplemental payoff being in the amount of about between 11,000 through 1.5 times said side bet.

21. The method according to claim 20, wherein said first supplemental payoff is about 100 times said side bet.

22. The method according to claim 19, said second supplemental payoff being in the amount of about between 500 through 1.5 times said side bet.

23. The method according to claim 22, wherein said second supplemental payoff is about 25 times said side bet.

24. The method according to claim 19, said third supplemental payoff being in the amount of about between 300 through 1.5 times said side bet.

25. The method according to claim 24, wherein said third supplemental payoff is about 25 times said side bet.

26. The method according to claim 13, further comprising a fourth supplemental payoff if one of (a) the first hand (b) the second hand, and (c) the third hand have a first predetermined final value, and further comprising a fifth supplemental payoff if one of (a) the first hand and (b) the second hand have a second predetermined final value.

27. The method according to claim 26, wherein said first and second predetermined final values are blackjack.

28. The method according to claim 27, said fourth supplemental payoff being in the amount of about between 10 through 1.5 times said side bet.

29. The method according to claim 28, wherein said fourth supplemental payoff is about 5 times said side bet.

30. The method according to claim 27, said fifth supplemental payoff being in the amount of about between 15 through 1.5 times said side bet.

31. The method according to claim 30, wherein said fifth supplemental payoff is about 5 times said side bet.

32. An improved method for a player and a dealer to play a two-handed version of the game of BLACKJACK, wherein the two-handed version of the game of BLACKJACK includes the player playing both a first hand and a second hand during a round of play and placing a first wager and a second wager respectively thereon; the dealer playing a hand; after any hits are taken the first hand having a first final value, the second hand having a second final value, and the dealer's hand having a third final value; the improvement comprising at least one of the following steps:

(1) the player receiving a first supplemental payoff if the first final value and the second final value and the third final value are all equal;

(2) the player receiving a second supplemental payoff if the first final value is equal to the second final;

(3) the player receiving a third supplemental payoff if one of (a) the first hand, (b) the hand, and (c) the third hand have a predetermined final value; and, (4) the player receiving a fourth supplemental payoff if one of (a) the first hand and (b) the second hand have a predetermined final value.

33. An improved method for a player and a dealer to play a two-handed version of the game of BLACKJACK, wherein the two-handed version of the game of BLACKJACK includes the player playing both a first hand and a second hand during a round of play and placing a first wager and a second wager respectively thereon; the dealer playing a hand; after the first two cards are dealt to the first hand and to the second hand and to the dealer's hand, the first hand having a first value, the second hand having a second value, and the dealer's hand having a third value; the improvement comprising at least one of the following steps:

(1) the player receiving a first supplemental payoff if the first value and the second value and the third value are all equal;

(2) the player receiving a second supplemental payoff if the first value is equal to the second value;

(3) the player receiving a third supplemental payoff if one of (a) the first value is equal to the third value and (b) the second value is equal to the third value;

(4) the player receiving a fourth supplemental payoff if one of (a) the first hand, (b) the second hand, and (c) the third hand have a predetermined value; and, (5) the player receiving a fifth supplemental payoff if one of (a) the first hand and (b) the second hand have a predetermined value.

34. An improved method for a player and a dealer to play a two-handed version of the game of BLACKJACK, wherein the two-handed version of the game of BLACKJACK includes the player playing both a first hand and a second hand during a round of play and placing a first wager and a second wager respectively thereon; the dealer playing a hand; after the first two cards are dealt to the first hand and to the second hand and to the dealer's hand, the first hand having a first value, the second hand having a second value, and the dealer's hand having a third value; the improvement comprising the steps of:

the player receiving a first supplemental payoff if the first value and the second value and the third value are all equal;

if the first value and the second value and the third value are not all equal, the player receiving a second supplemental payoff if the first value is equal to the second value; and, if the first value and the second value and the third value are not all equal, the player receiving a third supplemental payoff if one of (a) the first value is equal to the third value and (b) the second value is equal to the third value.

35. An improved method for a player and a dealer to play a two-handed version of the game of BLACKJACK, wherein the two-handed version of the game of BLACKJACK includes the player playing both a first hand and a second hand during a round of play and placing a first wager and a second wager respectively thereon; the dealer playing a hand; after the first two cards are dealt to the first hand and to the second hand and to the dealer's hand, the first hand having a first value, the second hand having a second value, and the dealer's hand having a third value; the improvement comprising the steps of:

the player placing a side bet;

the player receiving a first supplemental payoff if the first value and the second value and the third value are all equal;

if the first value and the second value and the third value are not all equal, the player receiving a second supplemental payoff if the first value is equal to the second value; and, if the first value and the second value and the third value are not all equal, the player receiving a third supplemental payoff if one of (a) the first value is equal to the third value and (b) the second value is equal to the third value.

* * * * *